United States Patent [19]

Letsche et al.

[11] Patent Number: 4,903,896

[45] Date of Patent: Feb. 27, 1990

[54] FUEL INJECTION DEVICE FOR AN INTERNAL COMBUSTION ENGINE HAVING PREINJECTION AND MAIN INJECTION AIR COMPRESSION AND SELF-IGNITION

[75] Inventors: Ulrich Letsche, Stuttgart; Günther Häfner, Berglen; Karl-Ernst Noreikat, Esslingen, all of Fed. Rep. of Germany

[73] Assignee: Daimler-Benz AG, Stuttgart, Fed. Rep. of Germany

[21] Appl. No.: 333,960

[22] Filed: Apr. 6, 1989

[30] Foreign Application Priority Data

Apr. 9, 1988 [DE] Fed. Rep. of Germany ..... 3811885

[51] Int. Cl.[4] ..... F02M 45/08; F02M 63/02

[52] U.S. Cl. ..... 239/88; 239/533.9

[58] Field of Search ..... 239/584, 585, 533.2, 239/533.3, 533.4, 533.7, 533.8, 533.9, 88, 90, 91

[56] References Cited

U.S. PATENT DOCUMENTS

| | | | |
|---|---|---|---|
| 4,403,740 | 9/1983 | Eblen et al. | 239/533.9 |
| 4,461,427 | 7/1984 | Kopsé et al. | 239/533.9 |
| 4,566,635 | 1/1986 | Trachte | 239/533.8 |
| 4,590,904 | 5/1986 | Wannenwetsch | 239/584 |
| 4,669,668 | 6/1987 | Ogawa | 239/533.8 |

FOREIGN PATENT DOCUMENTS

| | | | |
|---|---|---|---|
| 6934441 | 3/1981 | Fed. Rep. of Germany . | |
| 3330987 | 3/1985 | Fed. Rep. of Germany . | |
| 2189546 | 10/1987 | United Kingdom | 239/533.9 |

*Primary Examiner*—Andres Kashnikow
*Assistant Examiner*—Karen B. Merritt
*Attorney, Agent, or Firm*—Barnes & Thornburg

[57] ABSTRACT

The invention relates to a fuel injection device for an air-compressing fuel-injected internal combustion engine, which has an injection line leading from a pump element of high pressure injection pump to a bifurcation branch leading to a main injection nozzle and a preinjection nozzle. A nozzle needle of the preinjection nozzle opens counter to the direction of flow of the fuel and has a body designed with a stepped piston which, in the case of a closure initiating fuel pressure lying above an opening fuel pressure of the nozzle needle, moves the nozzle into a position to end preinjection.

20 Claims, 2 Drawing Sheets

FUEL INJECTION DEVICE FOR AN INTERNAL COMBUSTION ENGINE HAVING PREINJECTION AND MAIN INJECTION AIR COMPRESSION AND SELF-IGNITION

BACKGROUND AND SUMMARY OF THE INVENTION

The invention relates to a fuel injection device for an air-compression and self-ignition internal combustion engine having a high-pressure injection pump in which an injection line leads from each pump element thereof to a line bifurcation which is connected on the one hand to a main injection nozzle and on the other hand to a preinjection nozzle. The preinjection nozzle comprises a nozzle needle guided in a nozzle body which lifts off from its valve seat against the force of a restoring spring in response to fuel pressure being led to the preinjection nozzle and in a direction counter to the direction of flow of the fuel in a feed bore of the preinjection nozzle.

German Unexamined Pat. Application No. 33 30 987 discloses a fuel injection device which comprises a high-pressure injection pump and an auxiliary preinjection pump as an extraneous control for the preinjection nozzle.

Starting from the high-pressure injection pump, a high pressure injection line leads in a conventional manner to the main injection nozzle. A low pressure feed pump conveys fuel out of a tank into a delivery line at a low pressure, via a line bifurcation and an interposed damping reservoir, into a pump working space of the high pressure injection pump and then via an onward-leading line and a non-return valve, into a working space of the hydraulic auxiliary pump for the preinjection. The line systems for preinjection and main injection are separate.

The object on which the invention is based is to simplify the fuel injection device having preinjection and main injection and furthermore, to make possible a sharp division between the end of preinjection and the start of main injection.

This object is obtained by having a preinjection nozzle include a stepped piston in its nozzle body, which is pressed onto a sealing seat by spring force and is longitudinally displaceable in the body in response to fuel in the feed bore leading from the fuel injection pump to a connecting channel and wherein a closure initiating fuel pressure, which is above an opening fuel pressure of the nozzle needle, moves the needle nozzle into the position for ending preinjection of fuel.

Accordingly, the invention results in an automatically controlled system which operates without extraneous influence, such as an auxiliary pump, and which by virtue of the special nature of the nozzle needle closing function of the preinjection nozzle, prevents after dribble and ensures a sharp division between preinjection and main injection. This produces positive effects with regard to combustion noises, fuel consumption and exhaust gases by virtue of shortening of the duration of the preinjection phase as a consequence of the sharply falling end of preinjection, while at the same time still maintaining the same preinjection quantity as other systems.

It is advantageous if the stepped piston is arranged coaxially to the nozzle needle and is provided with a closing pin which cooperates to close the nozzle needle. The stepped piston has two piston parts of different diameters, of which the larger piston part is guided in the guiding body of preinjection nozzle and the smaller piston part, together with the guiding body, forms an annular chamber which can be connected to a connecting channel leading to the bifurcated fuel line when the closure initiating pressure is reached.

The stepped piston should have the sum of the areas of the annular surface formed between the piston parts and of the front face of the smaller piston part that faces the area of the connecting channel side be greater than the pressure shoulder of the nozzle needle to which fuel pressure is applied for causing opening of the nozzle needle.

It is also advantageous if the restoring spring, intended for biasing the nozzle needle, also simultaneously forms the closing spring for the stepped piston and surrounds the closing pin driving the nozzle needle. The spring is supported on one side by a nozzle needle spring plate and on the other side by a stepped piston spring plate. Also, when the nozzle needle is resting on its opening stop, the stepped piston is separated from the nozzle needle by an interval permitting a defined inactive stroke of the piston prior to the time its closing pin operates to close the needle nozzle of the preinjection nozzle.

Other objects, advantages and novel features of the present invention will become apparent from the following detailed description of the invention when considered in conjunction with the accompanying drawings.

DETAILED DESCRIPTION OF THE DRAWINGS

Figure 1:
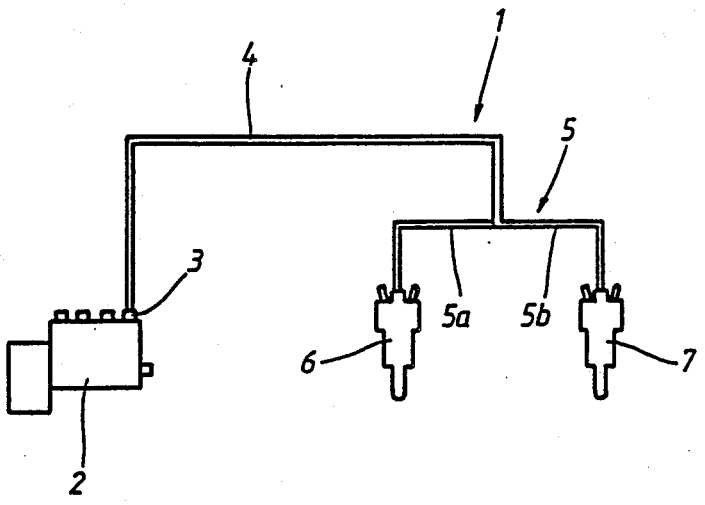
FIG. 1 shows a fuel injection device having a high pressure injection pump and a preinjection and a main injection nozzle.

FIG. 1 shows a fuel injection device 1 for an air-compressing, self-igniting internal combustion engine which essentially comprises a high pressure injection pump 2, an injection line 4 starting from each pump element 3 and having a line bifurcation 5 which is situated in the vicinity of the fuel ignition nozzles. One branch **5*a* from the bifurcation leads to a main injection nozzle 6 and the other branch 5*b* which is of equal length, leads to a preinjection nozzle 7**.

Figure 2:
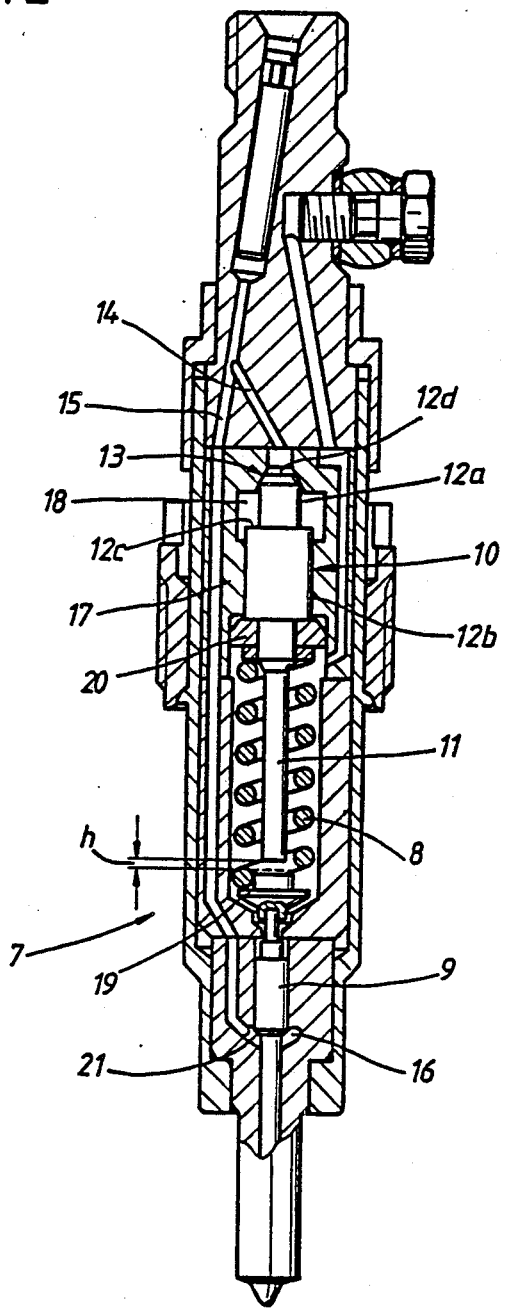
FIG. 2 shows the preinjection nozzle in longitudinal section.

The structure of the preinjection nozzle 7 is shown in FIG. 2 wherein on the rear side of a nozzle needle 9, which opens counter to the direction of flow of the fuel, is a restoring spring 8 opposing opening of the nozzle needle. Rearwardly of the spring 8 there is a closing body which is arranged coaxially to said nozzle needle and is designed as a stepped piston 10, provided with a closing pin 11 on the nozzle needle side and surrounded by the restoring spring 8.

The stepped piston 10 has a front face surface **12*d* which is connected to a piston part 12*a* of smaller diameter and rests on a valving seat 13. Connecting channel 14 leads to this piston part 12*a* and valving seat 13 from a feed bore 15 which traverses the injection nozzle 7 and opens into a pressure chamber 16 surrounding the nozzle needle 9**.

The piston part 12b of larger diameter is longitudinally guided and displaceable in a guiding body 17, and has an annular surface 12c which lies in an annular chamber 18 surrounding the stepped piston 10. The restoring spring 8 is supported between nozzle spring plate 19 on the nozzle needle 9 and a stepped piston spring plate 20 on the stepped piston 10. The closing pin 11 and the nozzle spring plate 19 are a short distance apart when the stepped piston 10 is in its closing position and the nozzle needle 9 is in its open position.

The incident pressure surface or front face surface 12d on the piston part 12a is smaller than the pressure shoulder 21 of the nozzle needle 9, and the sum of annular surface 12c and front face surface 12d is greater than the pressure shoulder 21. The mode of operation of the injection is as follows.

When the nozzle opening pressure is reached, the fuel pressure in pressure chamber 16 lifts off the nozzle needle 9 from its valve seat by a preinjection distance and counter to the force of the restoring spring 8. The nozzle needle 9 is limited in its open position by a conventional nozzle stop (not shown) to the position shown in FIG. 2. With this lifting off, preinjection begins. Meanwhile, the fuel pressure continues to rise to a closure initiating pressure. The closing initiating pressure is determined by the restoring spring force and the incident pressure of the fuel at the opening pressure of the main injection nozzle on the first face surface 12d on the piston part 12a. When the closure initiating pressure is reached, the stepped piston 10 begins to move in the direction of the nozzle needle 9, without altering the stop position of the nozzle needle. The path from the connecting channel 14 to the annular chamber 18 is free, with the result that the annular surface 12c on the piston part 12b also has applied to it a force from the fuel in the connecting line 14.

After the stepped piston 10 has passed through a certain inactive stroke (h) during its descending stroke caused by the pressure against surface 12d and 12c as opposed by spring 8, the closing pin 11 strikes against the nozzle spring plate 19 and moves the nozzle needle 9 to its closing position and preinjection is thus ended. Fuel is then withdrawn from the system in the conventional manner.

A delay in further fuel pressure rise is produced during a desired dwell following the closing of the preinjection needle nozzle and has the effect of increasing the time interval between preinjection and main injection. The main injection nozzle is only activated by a further increase in fuel pressure which is in excess of the fuel pressure necessary for preinjection. Main injection starts and is only ended by controlled opening of a control bore in the high-pressure injection pump 2. By virtue of the spring force, the stepped piston 10 returns to its starting position again. The annular surface 12c on the large diameter piston part 12b is thus hydraulically decoupled from the system pressure and afterdribble from the preinjection nozzle therefore cannot occur.

Figure 3:
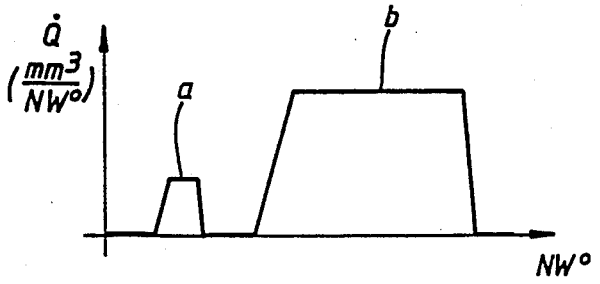
FIG. 3 shows a diagram which plots fuel injection rate against the pump angle.

The schedule of preinjection (a) and of main fuel injection (b) and the sharp division between preinjection and main fuel injection is shown in FIG. 3. NW° on the abscissa corresponds to the camshaft angle and Q° $mm^3$/NW° on the ordinate corresponds to the fuel quantity.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. Fuel injection device for an air compression and self-ignition internal combustion engine having preinjection and main injection, comprising:

a high pressure multi-pump element injection pump with an injection line leading from each pump element to a line bifurcation which is continuously connected to a main injection nozzle and to a feed bore of a preinjection nozzle;

the preinjection nozzle having a nozzle needle moveably guided in a nozzle body;

the nozzle needle being lifted off a value seat against the force of a restoring spring in response to fuel pressure of the fuel pump in the feed bore and counter to a direction of flow of fuel in the feed bore;

wherein the preinjection nozzle has a body in which a stepped piston is longitudinally displaceable;

the stepped piston is biased onto a sealing seat by spring force from the prestoring spring and is connected to the feed bore by a connecting channel; and wherein fuel pressure from the fuel injection pump in the feed bore is controlled by the high pressure injection pump to reach a closure initiating pressure in the feed bore which is above an opening pressure and which causes the stepped piston to open and move the nozzle needle into a closed position to end preinjection and to maintain the needle in said closed position until fuel pressure from the injection pump drops to a value allowing the stepped piston to close.

2. Fuel injection device according to claim 1, wherein the stepped piston is arranged coaxially with the nozzle needle and is provided with a closing pin which cooperates to close the nozzle needle.

3. Fuel injection device according to claim 2, wherein the restoring spring which biases the nozzle needle, simultaneously provides a closing spring force for the stepped piston; and said restoring spring surrounds the closing pin, and is supported between a nozzle needle spring plate and a stepped piston spring plate.

4. Fuel injection device according to claim 3, wherein the nozzle needle has an opening stop position and wherein the stepped piston is separated from the nozzle needle by an interval when the nozzle needle is first opened to define an inactive stroke (h) prior to the time the fuel pressure forces on the stepped piston cause the piston to move to close the needle valve.

5. Fuel injection device according to claim 1, wherein the nozzle needle has an opening stop position and wherein the stepped piston is separated from the nozzle needle by an interval when the nozzle needle is first opened to define an inactive stroke (h) prior to the time the fuel pressure forces on the stepped piston cause the piston to move to close the needle valve.

6. Fuel injection device according to claim 2, wherein the nozzle needle has an opening stop position and wherein the stepped piston is separated from the nozzle needle by an interval when the nozzle needle is first opened to define an inactive stroke (h) prior to the time the fuel pressure forces on the stepped piston cause the piston to move to close the needle valve.

7. Fuel injection device for an air compression and self-ignition internal combustion engine having preinjection and main injection, comprising:

a high pressure multi-pump element injection pump with an injection line leading from each pump element to a line bifurcation which is connected to a main injection nozzle and to a feed bore of a preinjection nozzle;

the preinjection nozzle having a nozzle needle moveably guided in a nozzle body;

the nozzle needle being lifted off a value seat against the force of a restoring spring in response to fuel pressure in the feed bore and counter to a direction of flow of fuel in the feed bore;

wherein the preinjection nozzle has a body in which a stepped piston is longitudinally displaceable;

the stepped piston is biased onto a sealing seat by spring force from the prestoring spring and is connected to the feed bore by a connecting channel;

wherein fuel pressure from the fuel injection pump in the feed bore is controlled by the high pressure injection pump to reach a closure initiating pressure in the feed bore which is above an opening pressure and which causes the stepped piston to open and move the nozzle needle into a position corresponding to end preinjection and wherein the stepped piston has two piston parts of different sized diameters;

the larger diameter piston part is guided in the nozzle body; and wherein the smaller piston part, together with the nozzle body, forms an annular chamber which can be connected to a connecting channel leading to the feed bore when the closure initiating pressure is reached.

8. Fuel injection device according to claim 7, wherein a sum of an area of an annular surface formed between the piston parts and of an area of a front face on the smaller piston part is greater than an area of a pressure shoulder of the nozzle needle to which the pressure is applied for lifting off the needle nozzle.

9. Fuel injection device according to claim 8, wherein the restoring spring which biases the nozzle needle, simultaneously provides a closing spring force for the stepped piston; and said restoring spring surrounds the closing pin, and is supported between a nozzle needle spring plate and a stepped piston spring plate.

10. Fuel injection device according to claim 9, wherein the nozzle needle has an opening stop position and wherein the stepped piston is separated from the nozzle needle by an interval when the nozzle needle is first opened to define an inactive stroke (h) prior to the time the fuel pressure forces on the stepped piston cause the piston to move to close the needle valve.

11. Fuel injection device according to claim 8, wherein the nozzle needle has an opening stop position and wherein the stepped piston is separated from the nozzle needle by an interval when the nozzle needle is first opened to define an inactive stroke (h) prior to the time the fuel pressure forces on the stepped piston cause the piston to move to close the needle valve.

12. Fuel injection device according to claim 7, wherein the restoring spring which biases the nozzle needle, simultaneously provides a closing spring force for the stepped piston; and said restoring spring surrounds the closing pin, and is supported between a nozzle needle spring plate and a stepped piston spring plate.

13. Fuel injection device according to claim 12, wherein the nozzle needle has an opening stop position and wherein the stepped piston is separated from the nozzle needle by an interval when the nozzle needle is first opened to define an inactive stroke (h) prior to the time the fuel pressure forces on the stepped piston cause the piston to move to close the needle valve.

14. Fuel injection device according to claim 7, wherein the nozzle needle has an opening stop position and wherein the stepped piston is separated from the nozzle needle by an interval when the nozzle needle is first opened to define an inactive stroke (h) prior to the time the fuel pressure forces on the stepped piston cause the piston to move to close the needle valve.

15. Fuel injection device for an air compression and self-ignition internal combustion engine having preinjection and main injection, comprising:

a high pressure multi-pump element injection pump with an injection line leading from each pump element to a line bifurcation which is connected to a main injection nozzle and to a feed bore of a preinjection nozzle;

the preinjection nozzle having a nozzle needle moveably guided in a nozzle body;

the nozzle needle being lifted off a value seat against the force of a restoring spring in response to fuel pressure in the feed bore and counter to a direction of flow of fuel in the feed bore;

wherein the preinjection nozzle has a body in which a stepped piston is longitudinally displaceable;

the stepped piston is biased onto a sealing seat by spring force from the prestoring spring and is connected to the feed bore by a connecting channel;

wherein fuel pressure from the fuel injection pump in the feed bore is controlled by the high pressure injection pump to reach a closure initiating pressure in the feed bore which is above an opening pressure and which causes the stepped piston to open and move the nozzle needle into a closed position corresponding to end preinjection wherein the stepped piston is arranged coaxially which the nozzle needle and is provided with a closing pin which cooperates to close the nozzle needle;

wherein the stepped piston has two piston parts of different sized diameters;

the larger diameter piston part is guided in the nozzle body; and wherein the smaller piston part, together with the nozzle body, forms an annular chamber which can be connected to a connecting channel leading to the feed bore when the closure initiating pressure is reached.

16. Fuel injection device according to claim 15, wherein a sum of an area of an annular surface formed between the piston parts and of an area of a front face on the smaller piston part is greater than an area of a pressure shoulder of the nozzle needle to which the pressure is applied for lifting off the needle nozzle.

17. Fuel injection device according to claim 16, wherein the nozzle needle has an opening stop position and wherein the stepped piston is separated from the nozzle needle by an interval when the nozzle needle is first opened to define an inactive stroke (h) prior to the time the fuel pressure forces on the stepped piston cause the piston to move to close the needle valve.

18. Fuel injection device according to claim 15, wherein the restoring spring which biases the nozzle needle, simultaneously provides a closing spring force for the stepped piston; and said restoring spring surrounds the closing pin, and is supported between a nozzle needle spring plate and a stepped piston spring plate.

19. Fuel injection device according to claim 18, wherein the nozzle needle has an opening stop position and wherein the stepped piston is separated from the nozzle needle by an interval when the nozzle needle is first opened to define an inactive stroke (h) prior to the time the fuel pressure forces on the stepped piston cause the piston to move to close the needle valve.

20. Fuel injection device according to claim 5, wherein the nozzle needle has an opening stop position and wherein the stepped piston is separated from the nozzle needle by an interval when the nozzle needle is first opened to define an inactive stroke (h) prior to the time the fuel pressure forces on the stepped piston cause the piston to move to close the needle valve.

* * * * *